US006787024B2

(12) United States Patent
Siskin et al.

(10) Patent No.: US 6,787,024 B2
(45) Date of Patent: Sep. 7, 2004

(54) PROCESS FOR REDUCING COKE AGGLOMERATION IN COKING PROCESSES

(75) Inventors: Michael Siskin, Randolph, NJ (US); Simon R. Kelemen, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/192,809

(22) Filed: Jul. 10, 2002

(65) Prior Publication Data

US 2003/0047072 A1 Mar. 13, 2003

Related U.S. Application Data

(60) Provisional application No. 60/304,212, filed on Jul. 10, 2001.

(51) Int. Cl.[7] ..... C10G 9/16

(52) U.S. Cl. ..... 208/48 R; 208/48 AA; 585/950; 95/237; 95/253

(58) Field of Search ..... 208/48 R, 48 AA, 208/131; 585/950; 95/237, 253

(56) References Cited

U.S. PATENT DOCUMENTS

| | | | | | |
|---|---|---|---|---|---|
| 3,843,744 | A | * | 10/1974 | Kramer et al. | 208/48 R |
| 4,085,056 | A | * | 4/1978 | Schenach | 252/59 |
| 4,756,820 | A | * | 7/1988 | Reid et al. | 208/48 AA |
| 5,672,793 | A | * | 9/1997 | Bares et al. | 585/5 |
| 6,303,019 | B1 | | 10/2001 | Siskin et al. | 208/48 |
| 6,471,852 | B1 | * | 10/2002 | Mark et al. | 208/48 AA |
| 6,533,922 | B2 | * | 3/2003 | Siskin et al. | 208/48 R |
| 6,585,883 | B1 | * | 7/2003 | Kelemen et al. | 208/48 AA |

* cited by examiner

*Primary Examiner*—Walter D. Griffin
*Assistant Examiner*—James Arnold, Jr.
(74) *Attorney, Agent, or Firm*—Erika S. Wilson; Jeremy J. Kliebert

(57) ABSTRACT

In an embodiment, the invention relates to a method for mitigating filter fouling from a coker gas oil by decomposing oligomers present in the gas oil.

18 Claims, 2 Drawing Sheets

PROCESS FOR REDUCING COKE AGGLOMERATION IN COKING PROCESSES

CROSS-REFERENCE TO RELATED APPLICATION

This application claims benefit of U.S. provisional patent application serial No. 60/304,212 filed Jul. 10, 2001.

FIELD OF THE INVENTION

In an embodiment, the invention relates to a method for mitigating filter fouling from a coker gas oil by decomposing oligomers present in the gas oil.

BACKGROUND OF THE INVENTION

Petroleum coking relates to processes for converting high boiling point, heavy petroleum feeds such as atmospheric and vacuum residuals ("resid") to petroleum coke ("coke") and hydrocarbon products having atmospheric boiling points lower than that of the feed. Some coking processes, such as delayed coking, are batch processes where the coke accumulates and is subsequently removed from a reactor vessel. In fluidized bed coking, for example fluid coking and FLEXICOKING™ (available from ExxonMobil Research and Engineering Co., Fairfax, Va.), lower boiling products are formed by the thermal decomposition of the feed at elevated reaction temperatures, typically about 900 to 1100° F. (about 480 to 590° C.) using heat supplied by fluidized coke particles.

Following coking, the lower boiling hydrocarbon products, such as coker gas oil, are separated in a separation region and conducted away from the process for storage or further processing. Frequently, the separated hydrocarbon products contain coke particles, particularly when fluidized bed coking is employed. Such coke particles may range in size upwards from submicron to several hundred microns, typically, submicron to about 50 $\mu$m. It is generally desirable to remove particles larger than about 25 $\mu$m to prevent fouling of downstream catalyst beds used for further processing. Filters, located downstream of the separation zone, are employed to remove coke from the products. Undesirably, solid hydrocarbonaceous particles present in the separated lower boiling hydrocarbon products may physically bind to each other and the filters, thereby fouling the filter and reducing filter throughput. Fouled filters must be back-washed, removed and mechanically cleaned, or both to remove the foulant.

There is therefore a need for a method for reducing foulant agglomeration in petroleum coking product streams.

SUMMARY OF THE INVENTION

Figure 1:
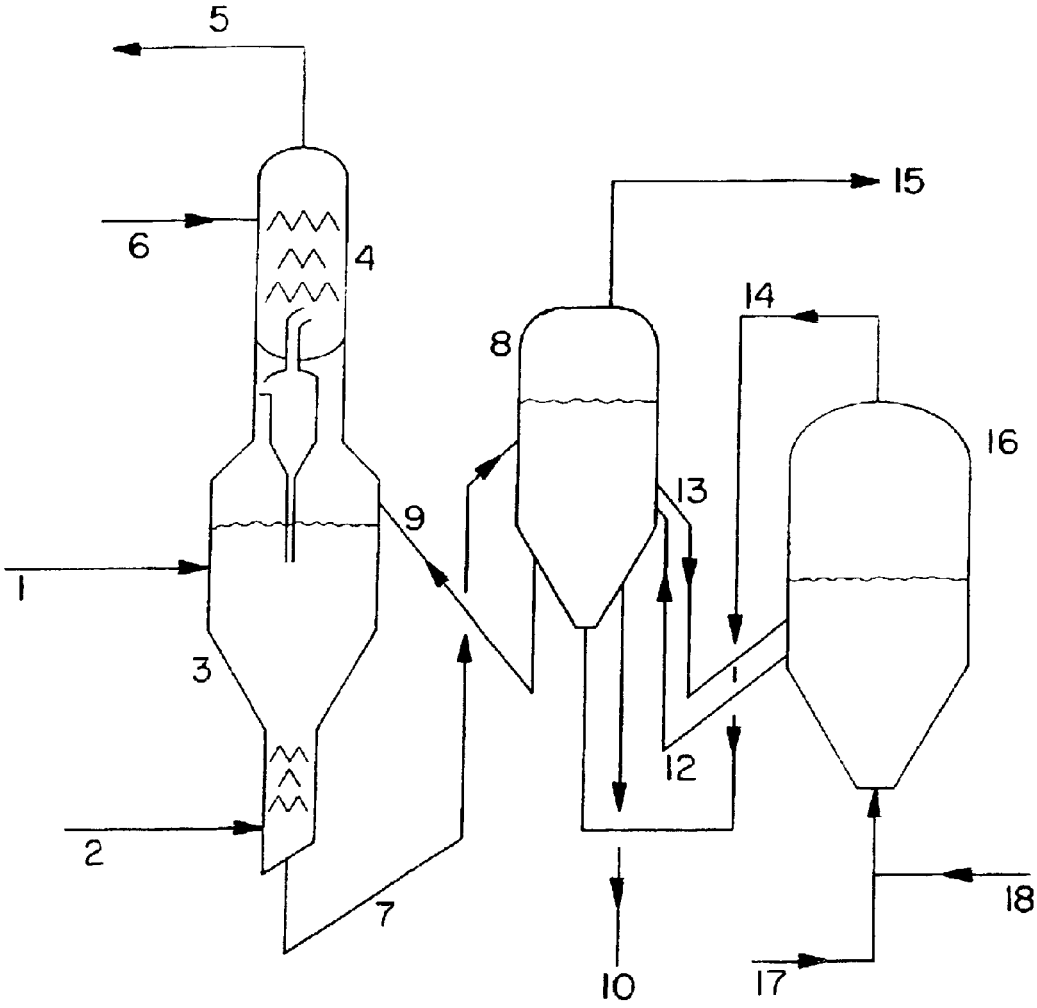
FIG. 1 is a schematic representation of a FLEXICOKING process.

In one embodiment, the invention relates to a method for reducing foulant agglomeration from a coker gas oil containing molecular oxygen, peroxides, or both, which method comprises:

a) conducting an effluent stream from a coking process to a first separation region;

b) separating at least a light fraction in the first separation region;

c) conducting steam and the light fraction to a second separation region and separating a vapor fraction and a liquid hydrocarbon fraction having a peroxide concentration;

d) conducting the liquid hydrocarbon fraction having a peroxide concentration back to the first separation region;

e) separating in the first separation region coker gas oil having a boiling point higher than the light fraction and containing oligomers; and f) heating the coker gas oil of step (e) to a temperature and for a time sufficient to decompose at least a fraction of the oligomers.

DETAILED DESCRIPTION OF THE INVENTION

In an embodiment, the invention is based in part on the discovery that solid foulant material can form in a separation zone downstream of a coking process. The foulant is a coke-like material that is high in hydrocarbon content, but low in metal content. While it is a coke like material, it is referred to herein as "foulant" to distinguish it from coke particles that have escaped from the coking process. It has also been discovered that foulant agglomeration results at least in part from the presence of macromolecules in the separation region having a molecular weight ranging from about 1000 to about 3000. Such macromolecules, including polymers and oligomers, but collectively referred to herein as oligomers, coat the coke's surface resulting in foulant particles that can adhere to each other and the filters.

The oligomers form largely from oxygen induced polymerization of conjugated dienes present in the coker effluent. Oligomers of conjugated dienes structurally contain one olefinic double bond per unit of conjugated diene polymerized. Additionally, styrenes and indenes present in the coker effluent may also be incorporated into the oligomers. As is known to those skilled in the art of polymerization, the presence of unsaturation in a polymer as results from the incorporation of olefinic double bonds and aromatics leads to the formation of a sticky polymer.

It is believed that filter fouling results when the oligomers coat the surface of coke in the high boiling fractions separated from the coker effluent. As temperature increases, these oligomers grow and can become insoluble, gummy materials. Potentially, each double bond in the oligomer is attached by physical interaction to the coke surface forming foulant. It is the sum of all the attachments that gives adhesive strength for the oligomer to hold onto the coke and form a tenacious multilayer sticky coating that then leads to filtering of fine coke particles that would otherwise pass through the filter. The filtering of these micron and submicron particles leads to premature plugging of the filters. The adhesive forces prevent the effective backflushing and regeneration of the plugged filters. While filter fouling may be experienced when processing effluent from any coker process, and the methods described herein may be used to control fouling in all coking processes, an embodiment for mitigating filter fouling in effluent from a FLEXICOKING process will be described in detail as a representative case.

Referring to FIG. 1, fresh feed containing one or more of heavy oil, resid, coal tar, shale oil, bitumen, and the like is pre-heated into a range of about 600° F. to about 700° F. (315 to 370° C.) and then conducted via line 1 to reactor 3 where the feed contacts a hot fluidized bed of coke obtained via line 9 from heater 8. The hot coke provides sensible heat and heat of vaporization for the feed and the heat required for the endothermic cracking reactions. The cracked vapor products pass through cyclone separators at the top of the reactor to remove coke particles for return to the bed. The vapors are then quenched in the scrubber 4 located above the reactor, where a portion (preferably a high boiling portion) of the cracked vapors are condensed and recycled to the reactor. The remaining cracked vapors are conducted to the coker fractionator via line 5. Wash oil is conducted to the scrubber via line 6 to provide quench cooling and to further reduce the amount of entrained coke particles.

Coke produced by cracking forms a deposit layer on the surface of existing coke particles in the reactor. Such coke is stripped with steam conducted to the reactor via line 2 and then returned to the heater via line 7 where it is heated to a temperature of about 1100° F. (593° C.). The heater serves to transfer heat from the gassifier 16 to the reactor.

Accordingly, coke flows via line 13 from the heater to the gassifier where the coke reacts with steam, conducted in via line 17 and air conducted in via line 18. A fuel gas product is formed comprising CO, $H_2$, $CO_2$, $N_2$, $H_2S$, and $NH_3$. Coke can be returned from the gassifier to the heater via line 12. Fuel gas is conducted from the top of the gassifier via line 14 to the bottom of the heater to assist in maintaining a fluidized coke bed in the heater. Coke gas is removed from the process via line 15. Coke is removed from the process via line 10.

Figure 2:
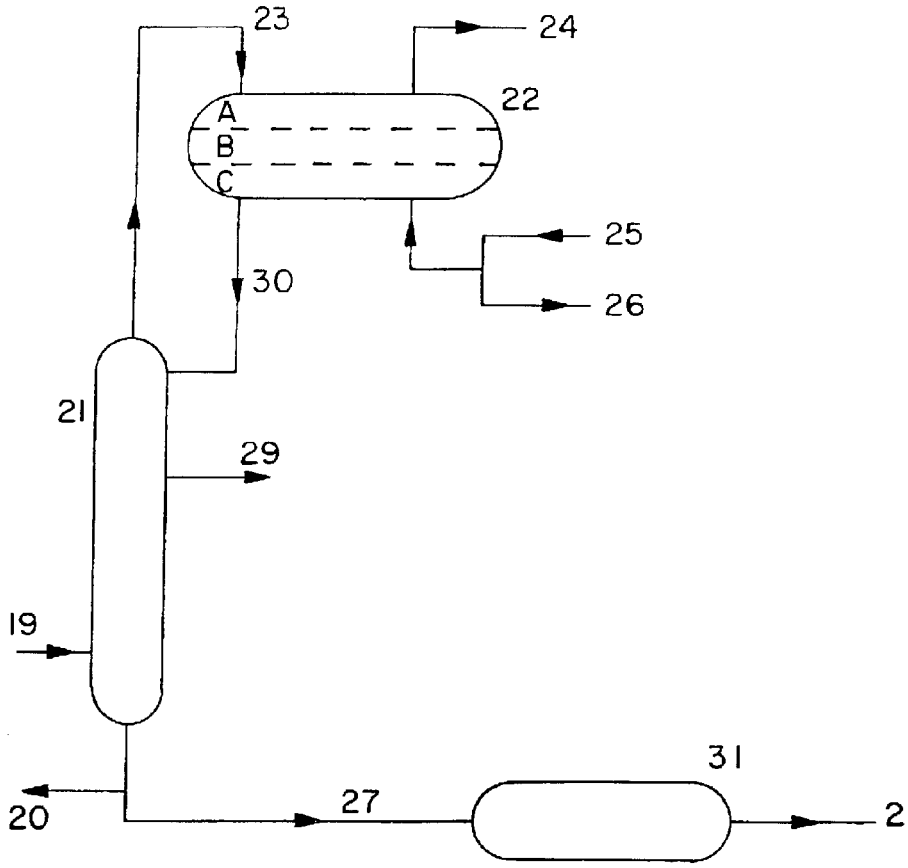
FIG. 2 is a schematic representation of a method for separating and filtering a gas oil product obtained from a coking process such as a FLEXICOKING process.

Referring now to FIG. 2, effluent from the coker is conducted to a first separation region, the coker fractionator 21, via line 19. A reflux stream of coker naphtha is separated from the top of the fractionator (temperature about 230° F. (110° C.) to about 260° F. (127° C.)) and conducted to a second separation region, drum 22, via line 23. Region 22 is maintained in thermal equilibrium at about 110° F. (43° C.). The coker naphtha is very reactive as it contains high concentrations of low molecular weight conjugated dienes compared to the higher boiling fractions. The coker naphtha also can contain styrenes and indenes.

Separation region 22 is divided into three zones. An upper zone (A) contains vapor phase material which may be withdrawn via line 24. An intermediate zone (B) contains liquid hydrocarbon to be returned to the coker fractionator 21. A lower zone (C) contains an aqueous liquid to maintain zone B at the proper level in region 22 so that it can be withdrawn via line 30. Pusher gas, preferably steam, is conducted to region 22 to maintain the aqueous phase at an appropriate level and to strip out vapors via line 24. Excess condensed aqueous material can be conducted away via line 26.

Wash oil is separated in the coker fractionator and returned to the coker via line 20. Coker gas oil is separated and conducted to filter 31 via line 27. Filtered gas oil is conducted away from the process via line 28.

It has been discovered that oxygen present in separation region 22 reacts largely with conjugated dienes and pyrroles in the coker naphtha to form peroxides. One way oxygen can be introduced into the process is via the pusher gas of line 25. Steam, e.g., obtained from other petroleum processes, may contain upwards of 100 ppm oxygen, based on the weight of the steam. Some refinery steam sources contain as much as 4500 ppm oxygen. The presence of more than 3 ppm oxygen in the steam will lead to the formation of significant quantities, about 0.5 to about 5 ppm, of peroxides with the conjugated dienes in the coker naphtha which, on subsequent heating from 110° F. (43° C.) to 230° F. (110° C.) on entering the top of the coker fractionator, initiate oligomer/polymer-forming chain reactions. Accordingly, unless oxygen is excluded from the process or scavenged, peroxide initiators will form, and the peroxides will initiate the formation of oligomers in the coker fractionator. In one embodiment, therefore, a pusher gas substantially free of oxygen, i.e. having less than about 100 ppm oxygen, preferably <10 ppm oxygen and more preferably <3 ppm oxygen, based on the weight of the pusher gas, is employed at separator 22. In an alternative embodiment, an oxygen scavenger is employed to remove molecular oxygen and peroxides. Preferably, the scavenger is combined with the coker naphtha recycled to the coker fractionator via line 30. While the scavenger could be employed with the pusher gas, it is believed that this approach would entail the use of far more scavenger, in view of the greater amount of oxygen in the pusher gas compared to the amount of peroxide in the liquid coker naphtha in line 30.

As discussed, when an oxygen scavenger is employed, it is preferably added to the coker naphtha liquid, before it enters the fractionator. The oxygen scavenger is preferentially added to a liquid phase versus a gas phase because oxygen solubility in liquid is very low. The scavenger will destroy soluble oxygen and existing peroxides before this feed component enters the fractionator and prevent oligomerization to form sticky gums. Oxygen scavengers can be generally used in the concentration range of 5 ppb to 300 ppm at temperatures from about 20–250° C. (68 to 482° F.), and include azodicarbonamides, 1,3-dimethyl-5-pyrazalones, urazoles, 6-azauracils, 3-methyl-5-pyrazalones, 3-methyl-5-pyrazolin-5-ones, N-aminomorpholines, 1-amino-4-methylpiperazines, N-aminohomopiperidines, N-aminohomopiperidines, 1-aminopyrrolinines, 1-aminopiperidines, 2,3-diaminopyridines, 2-amino-3-hydroxypyridines, 5-aminouracils, 5,6-diamino-1,3-dimethyluracils, hydroxyalkylhydroxylamines, hydrazine and it's derivatives and the like and mixtures thereof. Some of these materials may by catalyzed with a dioxo compound such as hydroquinone, benzoquinone, 1,2-dinaphthoquinone-4-sulfonic acid, pyrogallol, t-butylcatechol, etc. and mixtures thereof. The dioxo compounds are also effective oxygen scavengers. It should be noted that unlike antioxidants alone that will react with peroxides and not molecular oxygen, oxygen scavengers will react with both molecular oxygen and organic peroxides and are therefore preferred.

In yet another embodiment, the oligomers are allowed to form in the coker fractionator, but they are decomposed at or upstream of the filter 31. Operating the filters at a temperature greater than about 300° C. (572° F.), preferably 320–350° C. (608–662° F.), would thermally decompose (i.e., unzip) at least a portion of the sticky oligomerized material coating the foulant particle's surface at reasonable rates so carbon detritus can be back-flushed from the filter and separated from the process. As is known, polystyrenes unzip at a temperature of about 310° C. to about 350° C. (662° F.). Polybutadienes and styrene-butadiene copolymers require a temperature of about 400° C. (752° F.) to about 425° C. (797° F.) to unzip at reasonable rates. Periodic exposure of the fouled filters to higher temperature for short times is an acceptable route, e.g., 425° C. (797° F.) for 30 minutes.

EXAMPLES

Example 1

A coker effluent was conducted to a coker fractionator employed in a configuration similar to that forth in FIG. 2.

In addition to the heavy coker gas oil extracted via line 27, a light coker gas oil fraction boiling in the range of about 450 to 650° F. (232 to 343° C.) was separated via line 29. The light coker gas oil fraction was analyzed an found to contain about 1420 ppm of gums, based on the weight of the light coker gas oil. It is believed that the high level of gums results from contamination by oxygen. Oxygen contamination, as discussed, results in peroxide formation in the separation region or the coker fractionator and results in a thermally initiated oligomerization reaction of the peroxides with other reactive species in the feed, e.g., conjugated dienes. Conjugated dienes (except styrenes and indenes) do not polymerize thermally at the temperature employed in the coker fractionator at the level the light coker gas oil was extracted. Therefore, it is believed that the oligomers resulted from peroxide initiated oligomerization. It should be noted that coker gas oil fractions in the coker effluent do not contain any peroxides or gums.

In another study, X-ray photoelectron spectroscopy (XPS) was employed to measure the aromaticity on the surface of the foulant particles removed from a filter. Measured aromaticity ranged from about 53% to about 55%, whereas bed coke particles average between 75–95%. This lower level of aromaticity indicates a polymeric surface coating of lower aromatic material.

In another study, Gel Permeation Chromatography of the heptane extract of the carbon in a fouled filter indicated low concentrations of very tightly cross-linked material of molecular weight between 1000 and 3000.

Example 2

Solvent Soaks of Foulant Filters

A foulant filter (31 in FIG. 2) was removed from an operating coker process. A tared 1 inch (approx.) piece of the fouled filter was placed into a jar and soak solvent was added until the element was just covered. The soak liquid was gently swirled around the filter element for about 10 sec every 10 minutes during the first 30 min. The procedure was repeated for 12 hours, except that after the first 30 min. the element in the soak solution was maintained without agitation. The element was then removed with a tweezers and allowed to drip dry into the remaining soak liquid. The element was then placed in a clean jar and placed in a vacuum oven at 175° C. overnight.

The data in Table 1 indicates that soaking for 12 hours at room temperature removes all of the soluble material on the filter when Fluid Catalytic Cracking Unit ("FCCU") light heating oil (LHO) is used as the soak solvent. The heavy heating oil (HHO) and the light coker gas oil (LKGO) were not as effective. Both LHOs tested gave similar results, as did both HHOs. The LKGO was least effective. While it is not clear whether vacuum oven drying was sufficient to remove all of the heavier components of the HHOs, the data is self-consistent. Solvent soaks were minimally effective in removing oligomeric sticky coatings on the foulant surface because the filter cake remained essentially intact in the mesh of the filter.

TABLE 1

Room Temperature Solvent Soaks of Foulant Filters

| Soak Fluid | Time (hr) | Wt. Loss (g) | Wt. Loss (%) | Approx. % of Total Extractables |
|---|---|---|---|---|
| FCCU2 Light Heating Oil | 0.5 | 0.10 | 0.8 | 30 |
| | 12 | 0.33 | 3.0 | 100 |
| FCCU2 Heavy Heating Oil | 0.5 | +0.24 | — | — |
| | 12 | 0.21 | 1.8 | 67 |
| LKGO | 0.5 | 0.10 | 0.9 | 33 |
| | 12 | 0.16 | 1.1 | 41 |
| FCCU3 Light Heating Oil | 0.5 | 0.10 | 0.9 | 33 |
| | 12 | 0.37 | 3.0 | 100 |
| FCCU3 Heavy Heating Oil | 0.5 | 0.06 | 0.5 | 19 |
| | 12 | 0.23 | 1.5 | 56 |

In another study, additional extractions were repeated (Table 2), but this time the tared piece of filter element was first squirted vigorously with 100 mL of solvent in an attempt to wash off organic material and to dislodge as much of the carbon as possible before soaking the filter element overnight (with no agitation) in toluene to dissolve excess solvent. After vacuum oven drying at 100° C. (212° F.) the weight losses were minimal. Photographs, under the microscope, of the treated filter element pieces showed carbon particles impacted into the metal mesh of the filter element and it was not possible to differentiate additional impact of the treatment and soaks.

TABLE 2

Room Temperature Turbulent Solvent Washings of Foulant Filters

| Soak Fluid | Wt. Loss (g) | Wt. Loss (%) |
|---|---|---|
| FCCU2 Light Heating Oil | 0.15 | 2.3 |
| FCCU2 Heavy Heating Oil | 0.18 | 2.4 |
| LKGO | 0.14 | 2.0 |
| FCCU3 Light Heating Oil | 0.15 (0.15) | 2.4 (2.7) |
| FCCU3 Heavy Heating Oil | 0.15 | 1.8 |
| Toluene | 0.25 | 3.1 |

In yet another study set forth in Table 3, extraction was carried out with vigorous agitation at 239° C. (462° F.), the operating temperature of the filters. A highly aromatic solvent (99%), a light heating oil, and toluene were compared. The solvent was drained immediately after cooling to room temperature to prevent re-contamination and the filter element pieces were also squirted with 100 mL of each solvent. The filter elements were then soaked overnight to remove excess solvent and then dried overnight in a vacuum oven at 100° C. (212° F.). Again, even at 239° C., the physical interaction of the organics with the carbon in the filter element was not disrupted.

TABLE 3

| Turbulent Solvent Washings of Foulant Filters at 239° C. (462° F.) | | |
|---|---|---|
| Soak Fluid | Wt. Loss (g) | Wt. Loss (%) |
| BAKA Energy (Car = 99%) | 0.05 | 2.0* |
| FCCU3 Light Heating Oil | 0.06 | 2.2 |
| Toluene | 0.05 | 2.0 |

*1.83 wt. % at 20° C. (68° F.)

These data demonstrate that solvent washing is not adequate to remove the sticky layer on the carbon and permit the carbon to be dislodged from the wire mesh in the filter element.

Example 3

The following simple experiments were carried out on a polystyrene oligomer (PS) of about 25 units with the Vacuum Topped Bitumen (VTB) which is a typical fluidized-bed coker feed.

| | Viscosity at 80° C. (CPS) |
|---|---|
| Untreated | |
| VTB | 96,800 |
| VTB + 2% PS MW = 2500 | 96,800 |
| Heated at 360° C. for 3 h | |
| VTB | 9,400 |
| VTB + 2% PS MW = 2500 | 4,500 |
| Heated at 360° C. for 0.5 h | |
| VTB | 23,000 |
| VTB + 2% PS MW = 2500 | 15,600 |

Polystyrene has no effect on the viscosity of unheated VTB. Heating for 3 h at 360° C. decreased the viscosity of the VTB tenfold. However, in the presence of 2 wt. % PS of MW=2500 the viscosity is cut in half again by heating. This indicated that if sticky oligomers are present on the carbon in the filter a longer heat soak would be beneficial in shortening/unzipping the sticky oligomeric chains. How short the residence time should be for the oligomers to become non-sticky, as in the 0.5 h data, depends on the extent of oligomerization that has taken place, as can be readily determined by e.g., elution methods.

What is claimed is:

1. A method for reducing foulant from a coker gas oil containing molecular oxygen and peroxides, which method comprises:

a) conducting an effluent stream from a coking process to a first separation region;

b) separating at least a light fraction in the first separation region;

c) conducting steam and the light fraction to a second separation region and separating a vapor fraction and a liquid hydrocarbon fraction having a peroxide concentration;

d) conducting the liquid hydrocarbon fraction having a peroxide concentration back to the first separation region;

e) separating in the first separation region the coker gas oil having a boiling point higher than the light fraction and containing oligomers; and (f) heating the coker gas oil to a temperature and for a time sufficient to decompose the oligomers.

2. The method of claim 1 wherein the light fraction in the first separation region is separated at a temperature ranging from about 230° F. (110° C.) to about 260° F. (127° C.).

3. The method of claim 1 wherein the coker gas oil in step (f) is heated to a temperature from about 572° F. (300° C.) to about 797° F. (425° C.).

4. A method of claim 1 wherein the steam contains less than about 100 wppm oxygen.

5. A method of claim 1 wherein the steam contains less than about 10 wppm oxygen.

6. A method of claim 1 wherein the steam contains less than about 3 wppm oxygen.

7. A method for reducing foulant from a coker gas oil containing molecular oxygen and peroxides, which method comprises:

a) conducting an effluent stream from a coking process to a first separation region;

b) separating at least a light fraction in the first separation region;

c) conducting steam and the light fraction to a second separation region and separating a vapor fraction and a liquid hydrocarbon fraction having a peroxide concentration;

d) combining an oxygen scavenger to the liquid hydrocarbon fraction having a peroxide concentration while conducting the liquid hydrocarbon fraction back to the first separation region;

e) separating in the first separation region the coker gas oil having a boiling point higher than the light fraction and containing oligomers; and f) heating the coker gas oil to a temperature and for a time sufficient to decompose the oligomers.

8. The method of claim 7 wherein the light fraction in the first separation region is separated at a temperature ranging from about 230° F. (110° C.) to about 260° F. (127° C.).

9. The method of claim 8 wherein the coker gas oil in step (f) is heated to a temperature from about 572° F. (300° C.) to about 797° F. (425° C.).

10. A method of claim 7 wherein the steam contains less than about 100 wppm oxygen.

11. A method of claim 7 wherein the steam contains less than about 10 wppm oxygen.

12. A method of claim 7 wherein the steam contains less than about 3 wppm oxygen.

13. A method of claim 7 wherein the oxygen scavenger is selected from a group consisting of azodicarbonamides, 1,3-dimethyl-5-pyrazalones, urazoles, 6-azauracils, 3-methyl-5-pyrazalones, 3-methyl-5-pyrazolin-5-ones, N-aminomorpholines, 1-amino-4-methylpiperazines, N-aminohomopiperidines, N-aminohomopiperidines, 1-aminopyrrolinines, 1-aminopiperidines, 2,3-diaminopyridines, 2-amino-3-hydroxypyridines, 5-aminouracils, 5,6-diamino-1,3-dimethyluracils, hydroxyalkylhydroxylamines, hydrazines, and mixtures thereof.

14. A method of claim 13 wherein the oxygen scavenger is catalyzed with a dioxo compound.

15. A method of claim 14 wherein the dioxo compound is selected from a group consisting of hydroquinone, benzoquinone, 1,2-dinaphthoquinone-4-sulfonic acid, pyrogallol, t-butylcatechol, etc. and mixtures thereof.

16. A method for reducing foulant from a coker gas oil containing molecular oxygen or peroxides, which method comprises:

a) conducting an effluent stream from a coking process to a first separation region;

b) separating at least a light fraction in the first separation region;

c) separating in the first separation region the coker gas oil having a boiling point higher than the light fraction and containing oligomers; and d) heating the coker gas oil to a temperature and for a time sufficient to decompose the oligomers.

17. The method of claim 16 wherein the light fraction in the first separation region is separated at a temperature ranging from about 230° F. (110° C.) to about 260° F. (127° C.).

18. The method of claim 16 wherein the coker gas oil in step (d) is heated to a temperature from about 572° F. (300° C.) to about 797° F. (425° C.).

* * * * *